US011810526B2

(12) United States Patent
Chen et al.

(10) Patent No.: US 11,810,526 B2
(45) Date of Patent: Nov. 7, 2023

(54) E-PAPER DISPLAY APPARATUS AND E-PAPER DISPLAY PANEL

(71) Applicant: E Ink Holdings Inc., Hsinchu (TW)

(72) Inventors: Wei-Tsung Chen, Hsinchu (TW); Xue-Hung Tsai, Hsinchu (TW)

(73) Assignee: E Ink Holdings Inc., Hsinchu (TW)

( * ) Notice: Subject to any disclaimer, the term of this patent is extended or adjusted under 35 U.S.C. 154(b) by 0 days.

(21) Appl. No.: 17/949,182

(22) Filed: Sep. 20, 2022

(65) Prior Publication Data

US 2023/0178040 A1 Jun. 8, 2023

(30) Foreign Application Priority Data

Dec. 2, 2021 (TW) ..... 110144978

(51) Int. Cl.
*G09G 3/34* (2006.01)

(52) U.S. Cl.
CPC ..... *G09G 3/344* (2013.01); *G09G 2300/0842* (2013.01); *G09G 2310/08* (2013.01); *G09G 2330/021* (2013.01)

(58) Field of Classification Search
None
See application file for complete search history.

(56) References Cited

U.S. PATENT DOCUMENTS

| | | | | |
|---|---|---|---|---|
| 9,202,441 | B2 | 12/2015 | Liu | |
| 10,418,388 | B2 | 9/2019 | Kim et al. | |
| 10,490,128 | B1 * | 11/2019 | Qian | G09G 3/3266 |
| 10,522,609 | B2 | 12/2019 | Woo et al. | |
| 2017/0193949 | A1 | 7/2017 | Kim | |
| 2019/0381316 | A1 * | 12/2019 | Rozgic | A61N 1/0531 |
| 2021/0233458 | A1 * | 7/2021 | Yang | G09G 3/3225 |

FOREIGN PATENT DOCUMENTS

| | | |
|---|---|---|
| TW | 200636663 | 10/2006 |
| TW | 202030714 | 8/2020 |

OTHER PUBLICATIONS

"Office Action of Taiwan Counterpart Application", dated Sep. 12, 2022, p. 1-p. 6.

* cited by examiner

*Primary Examiner* — Andre L Matthews
(74) *Attorney, Agent, or Firm* — JCIPRNET

(57) ABSTRACT

An e-paper display apparatus including an e-paper display panel is provided. The e-paper display panel includes multiple pixel circuits arranged in an array. Each of the pixel circuits includes a transistor device. The transistor device is an oxide thin-film transistor. A set of signal waveforms for driving the pixel circuits to display image pages includes multiple frames. In a low panel frequency mode, the number of the frames is less than ten.

7 Claims, 5 Drawing Sheets

E-PAPER DISPLAY APPARATUS AND E-PAPER DISPLAY PANEL

CROSS-REFERENCE TO RELATED APPLICATION

This application claims the priority benefit of Taiwan application serial no. 110144978, filed on Dec. 2, 2021. The entirety of the above-mentioned patent application is hereby incorporated by reference herein and made a part of this specification.

BACKGROUND

Technical Field

The disclosure relates to a display apparatus and a display panel thereof, and in particular, to an e-paper display apparatus and an e-paper display panel thereof.

Description of Related Art

An e-paper display apparatus (e.g. an electrophoretic display) may be adopted as an electric tag. In the application of the electric tag, the power consumption has to be extremely low, and the electric tag has to be wirelessly charged to be driven by a charging device. For example, the charging device may charge the electric tag through near-field communication (NFC).

In the conventional technology, to reduce the power consumption, a driving voltage of the electric tag may be lowered by adjusting a front panel laminate (FPL) material. However, reducing the power consumption in this way may compromise the display quality of the electric tag. The power consumption of the electric tag may also be reduced by lowering an update frequency of the electric device. However, in this way, a page update time of the electric tag may be increased, so it is not allowed to be adopted.

Therefore, it is necessary to design an e-paper display apparatus exhibiting low power consumption and providing favorable display quality.

SUMMARY

The disclosure is directed to an e-paper display apparatus and an e-paper display panel thereof. The e-paper display apparatus exhibits low power consumption and provides favorable display quality.

The e-paper display apparatus provided in the disclosure includes an e-paper display panel. The e-paper display panel includes multiple pixel circuits arranged in an array. Each of the pixel circuits includes a transistor device. The transistor device is an oxide thin-film transistor. A set of signal waveforms for driving the pixel circuits to display image pages includes multiple frames. In a low panel frequency mode, a number of the frames is less than ten.

In an embodiment of the disclosure, each of the pixel circuits further includes a storage capacitor coupled to the transistor device. A capacitance density of the storage capacitor is greater than 50 $\mu F/m^2$.

In an embodiment of the disclosure, in the low panel frequency mode, a page update frequency of the e-paper display panel is less than 30 Hz.

In an embodiment of the disclosure, a material of a channel layer of the oxide thin-film transistor is indium gallium zinc oxide or indium zinc tin oxide.

An e-paper display panel of the disclosure includes multiple pixel circuits arranged in an array. Each of the pixel circuits includes a transistor device, a storage capacitor, and a pixel capacitor. A data voltage drives the storage capacitor and the pixel capacitor through the transistor device to cause the e-paper display panel to display image pages. The transistor device is an oxide thin-film transistor. A capacitance density of the storage capacitor is greater than 50 $\mu F/m^2$.

In an embodiment of the disclosure, a set of signal waveforms for driving the pixel circuits to display the image pages includes multiple frames. In a low panel frequency mode, a number of the frames is less than ten.

In order to make the aforementioned features and advantages of the disclosure comprehensible, embodiments accompanied with drawings are described in detail below.

DESCRIPTION OF THE EMBODIMENTS

Figure 1:
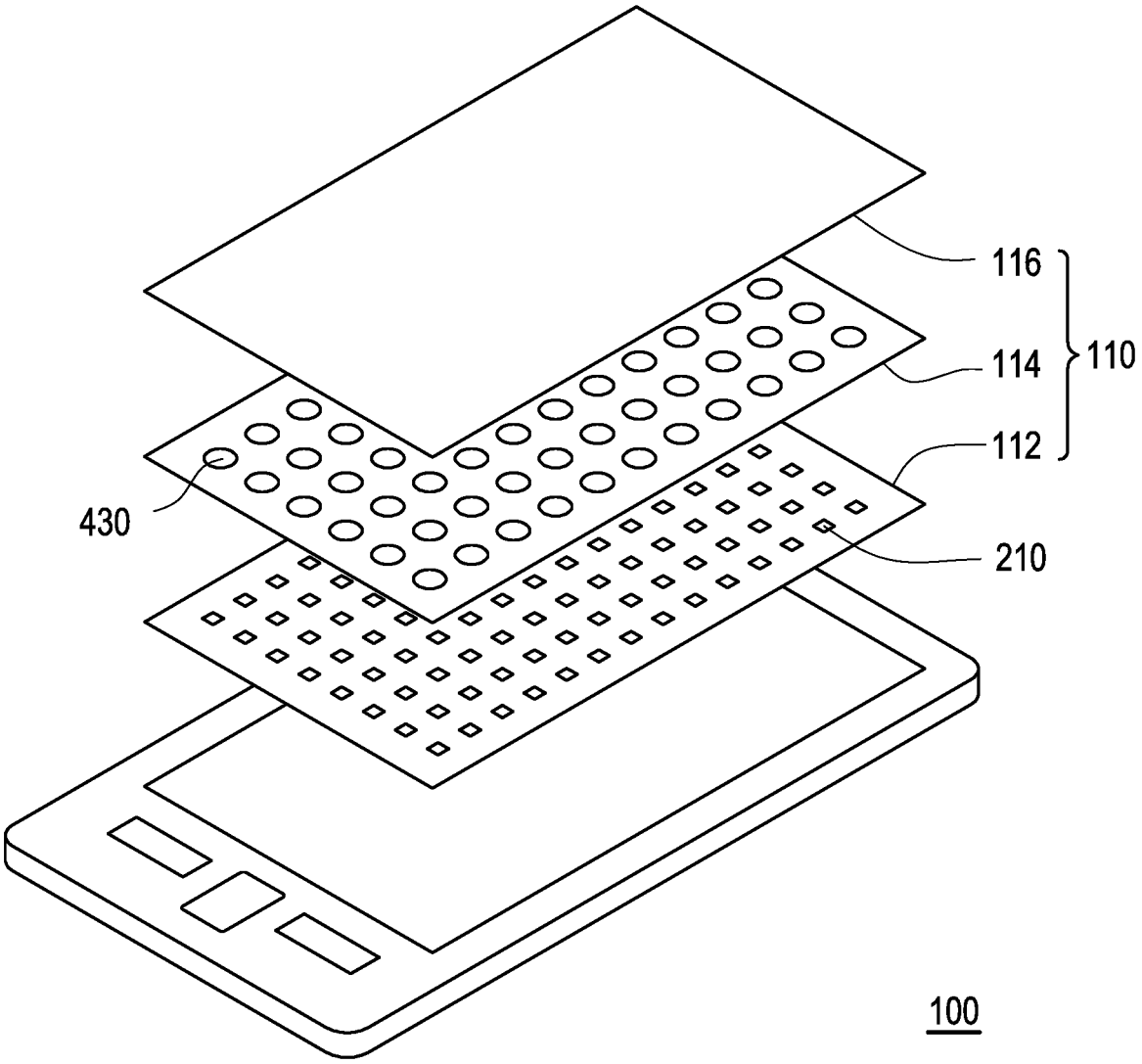
FIG. 1 is a schematic diagram of an e-paper display apparatus according to an embodiment of the disclosure.
Figure 2:
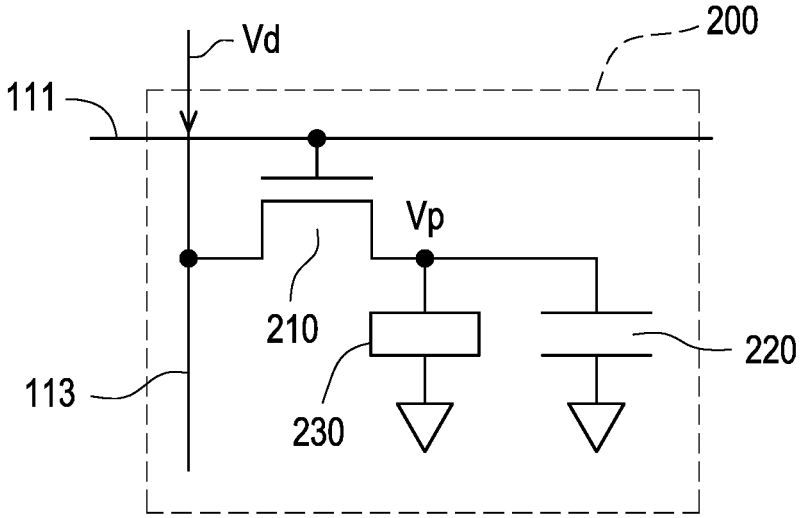
FIG. 2 is a schematic diagram of a pixel circuit of the e-paper display apparatus of an embodiment of FIG. 1.

FIG. 1 is a schematic diagram of an e-paper display apparatus according to an embodiment of the disclosure. FIG. 2 is a schematic diagram of a pixel circuit of the e-paper display apparatus of an embodiment of FIG. 1. Referring to FIG. 1, an e-paper display apparatus 100 includes an e-paper display panel 110. The e-paper display panel 110 includes layer structures such as a circuit layer 112, an electrophoresis layer 114, and a protection layer 116. The e-paper display panel 110 includes multiple pixel circuits 200 arranged in an array. The pixel circuit 200 includes a transistor device 210, a storage capacitor 220, and a pixel capacitor 230. A pixel voltage of the pixel capacitor 230 is denoted by Vp. The storage capacitor 220 is coupled to the transistor device 210.

Specifically, the circuit layer 112 is, for example, a thin-film transistor substrate and includes the multiple transistor devices 210 arranged in an array. The technology of electrophoretic ink is generally known as electronic ink. The electronic ink is formed on a plastic thin film to form the electrophoresis layer 114. The electrophoresis layer 114 is attached to the circuit layer 112 to be driven by a driving chip to display an image page. The protection layer 116 as a protection film is configured to protect the layer structures of the e-paper display panel 110.

Figure 3:
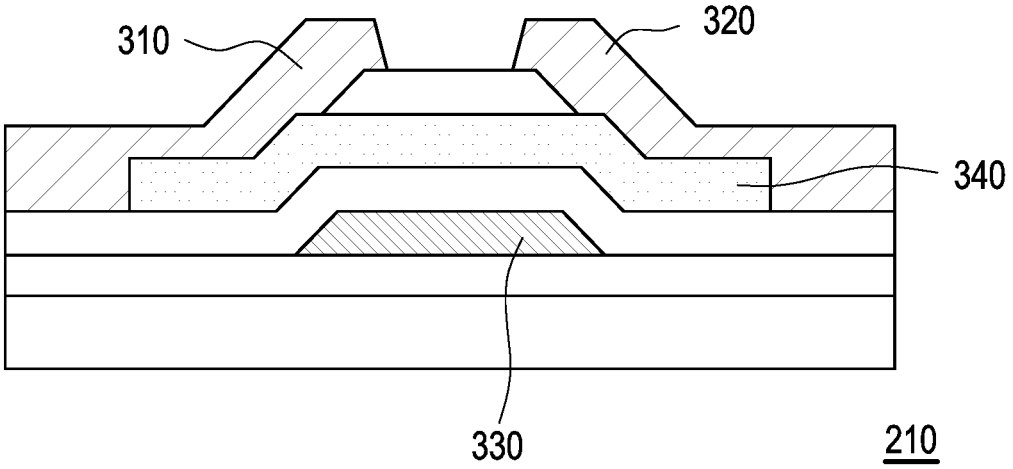
FIG. 3 is a schematic diagram of a structure of a transistor device of an embodiment of FIG. 2.

FIG. 3 is a schematic diagram of a structure of a transistor device of an embodiment of FIG. 2. Referring to FIG. 2 and FIG. 3, the transistor device 210 of FIG. 2 is implemented, for example, as an oxide thin-film transistor, and the structure therefore is as shown in FIG. 3. The transistor device 210 includes a first source/drain 310, a second source/drain 320, a gate electrode 330, and a channel layer 340. A material of the channel layer 340 is an oxide, such as indium gallium zinc oxide (IGZO) or indium zinc tin oxide (IZTO). The oxide thin-film transistor exhibits a property of very low off current. Hence, the oxide thin-film transistor may maintain a pixel voltage in a low panel frequency mode. The oxide thin-film transistor structure and the material of the channel layer of FIG. 3 are only illustrative, and they are not intended to limit the disclosure.

Figure 4A:
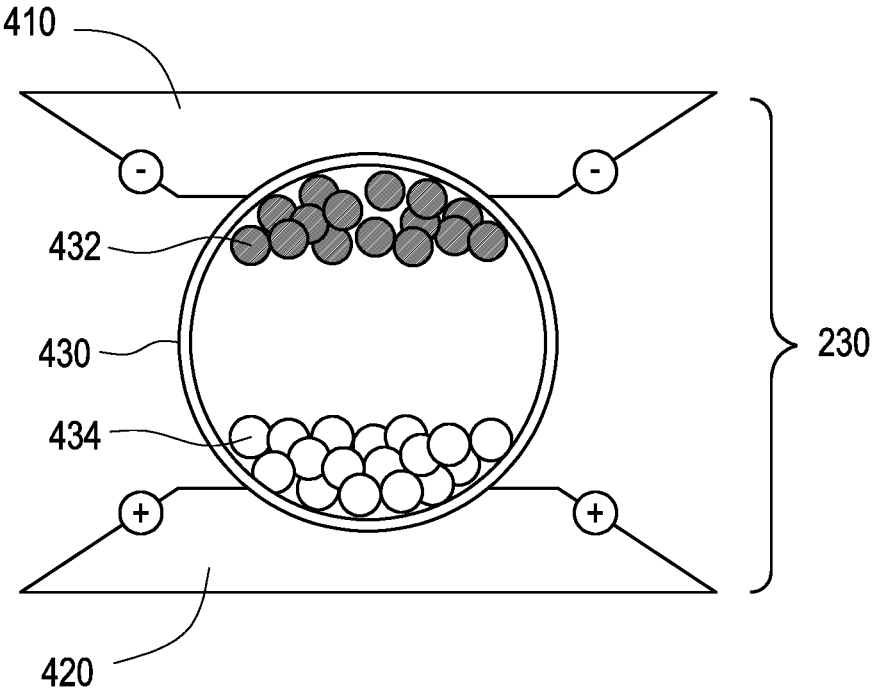
FIG. 4A and FIG. 4B are schematic diagrams respectively illustrating microcapsules in an electrophoresis layer of the embodiment of FIG. 2 in different states.
Figure 4B:
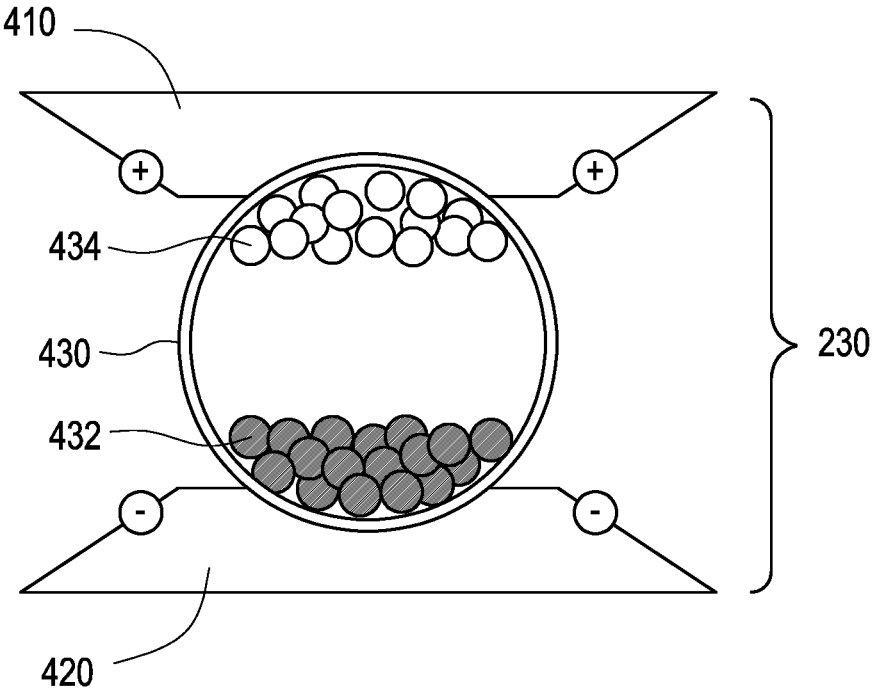

FIG. 4A and FIG. 4B are schematic diagrams respectively illustrating microcapsules in an electrophoresis layer of the embodiment of FIG. 2 in different states. Referring to FIG. 2, FIG. 4A, and FIG. 4B, the electrophoresis layer 114 includes millions of microcapsules 430. A diameter of the microcapsules 430 is approximately equal to a diameter of human hair. Each of the microcapsules 430 includes electrophoretic particles. The electrophoretic particles are negatively charged white particles 434 and positively charged black particles 432 suspended in a transparent liquid. The size of the microcapsules 430 and the color of the electrophoretic particles are not intended to limit the disclosure. That is, the e-paper display apparatus 100 may display a dual-color (white and black), three-color (white, red, and black), four-color (white, red, yellow, black), or multi-color image page.

An upper electrode 410 and a lower electrode 420 of the electrophoresis layer 114 form the pixel capacitor 230. During a driving period, a scan signal causes the transistor device 210 to be turned on through a scan line 111. Next, a data voltage Vd is written into the pixel circuit 200 through a data line 113 to drive the pixel circuit 200 to display the image page. When the data voltage Vd is applied to the upper electrode 410 and the lower electrode 420, the electrophoretic particles are driven to move. In FIG. 4A, a negative voltage is applied to the upper electrode 410 and a positive voltage is applied to the lower electrode 420 to drive the positively charged black particles 432 to move toward the upper electrode 410 and drive the negatively charged white particles 434 to move toward the lower electrode 420. As a result, the pixel is presented as black. In FIG. 4B, the positive voltage is applied to the upper electrode 410 and the negative voltage is applied to the lower electrode 420 to drive the positively charged black particles 432 to move toward the lower electrode 420 and drive the negatively charged white particles 434 to move toward the upper electrode 410. As a result, the pixel is presented as white.

In the embodiment, since the transistor device 210 of FIG. 2 is implemented as the oxide thin-film transistor, an initial voltage may be maintained to drive the electrophoretic particles. Furthermore, the e-paper display panel 110 is operated in a low frame number mode, effectively reducing the power consumption of the e-paper display apparatus 100. Hence, the energy consumption may be reduced, and the display quality of the e-paper display panel 110 is maintained.

Figure 5:
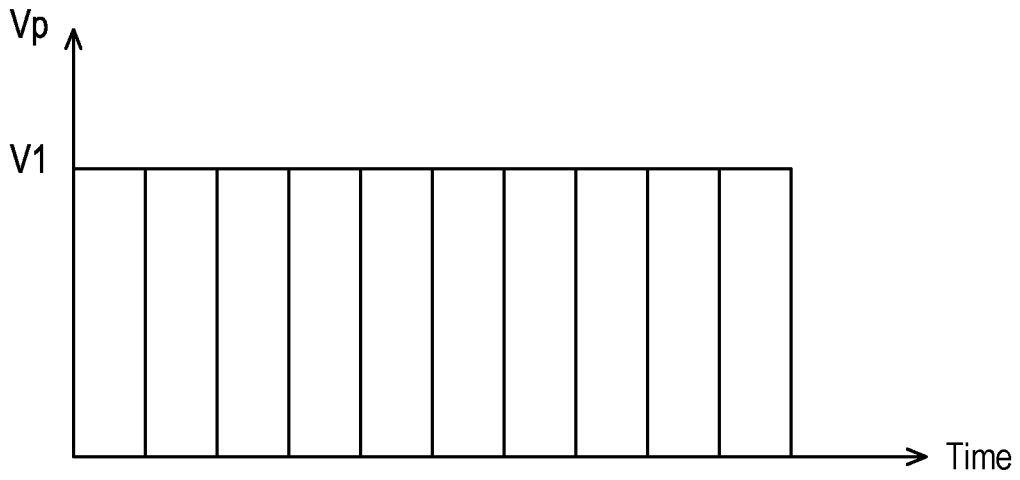
FIG. 5 is a schematic diagram illustrating waveforms of a pixel voltage according to an embodiment of the disclosure.

FIG. 5 is a schematic diagram illustrating waveforms of a pixel voltage according to an embodiment of the disclosure. Referring to FIG. 1, FIG. 2, and FIG. 5, FIG. 5 is a schematic diagram illustrating waveforms of the e-paper display panel 110 operated in a general mode. In the general mode, a set of signal waveforms for driving the pixel circuits 200 to display the image pages as shown in FIG. 5 includes ten frames. During the driving period, when the transistor device 210 is turned on, a data voltage similar to the waveforms of FIG. 5 is written into the pixel circuit 200 through the data line 113 to drive the pixel circuit 200 to display the image page. Since the transistor device 210 is implemented as the oxide thin-film transistor and exhibits the property of very low off current, when the transistor device 210 is not turned on, a pixel voltage Vp of the pixel capacitor 230 may maintain the voltage waveforms as shown in FIG. 5, such as maintaining the voltage waveforms at a voltage value V1.

Figure 6:
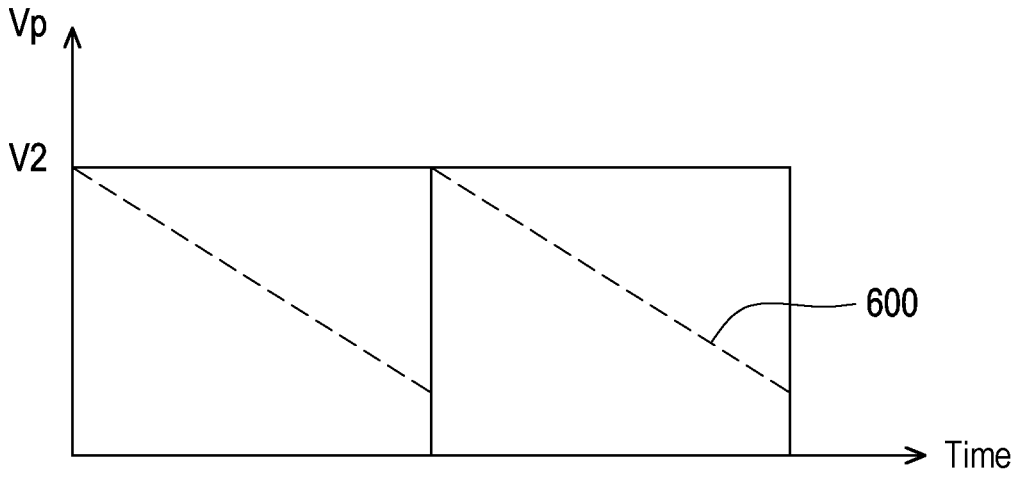
FIG. 6 is a schematic diagram illustrating waveforms of a pixel voltage according to another embodiment of the disclosure.

FIG. 6 is a schematic diagram illustrating waveforms of a pixel voltage according to another embodiment of the disclosure. Referring to FIG. 1, FIG. 2, and FIG. 6, FIG. 6 is a schematic diagram illustrating waveforms of the e-paper display panel 110 operated in the low panel frequency mode, such as a page update frequency of the e-paper display panel 110 being less than 30 Hz and a number of frames being less than 10. In the low panel frequency mode, a set of signal waveforms for driving the pixel circuits 200 to display the image pages as shown in FIG. 6 includes two frames. During the driving period, when the transistor device 210 is turned on, a data voltage similar to the waveforms of FIG. 6 is written into the pixel circuit 200 through the data line 113 to drive the pixel circuit 200 to display the image page. Since the transistor device 210 is implemented as the oxide thin-film transistor and exhibits the property of very low off current, when the transistor device 210 is not turned on, the pixel voltage Vp of the pixel capacitor 230 may maintain the voltage waveforms as shown in FIG. 6, such as maintaining the voltage waveforms at a voltage value V2. The voltage value V2 and the voltage value V1 may be equal or not equal. In the embodiment, for example, two frames are included, but the disclosure is not limited thereto. The disclosure may be applied to the low panel frequency mode and in a case where the number of frames is less than 10. The energy consumption may be reduced, and the display quality may be maintained.

In the embodiment, a capacitance density of the storage capacitor 220 may be designed to be greater than 50 $\mu F/m^2$ to maintain the pixel voltage Vp at the voltage value V2 to enhance the display quality.

In a case where the oxide thin-film transistor is not adopted to implement the transistor device 210, the pixel voltage of the pixel capacitor 230 may be as shown in a dotted line 600. Serious current leakage may occur, and the voltage is not able to be maintained at the voltage value V2.

Figure 7:
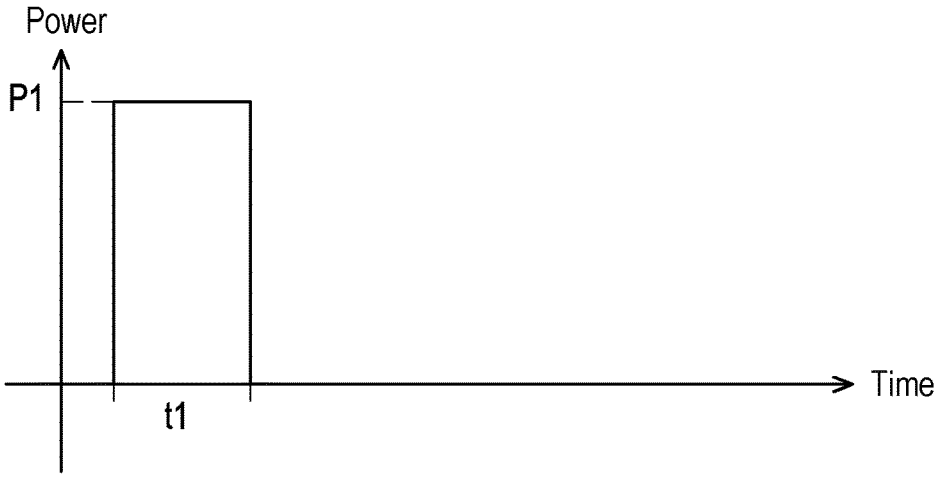
FIG. 7 and FIG. 8 are schematic diagrams illustrating a page update time and power of an e-paper display panel.
Figure 8:
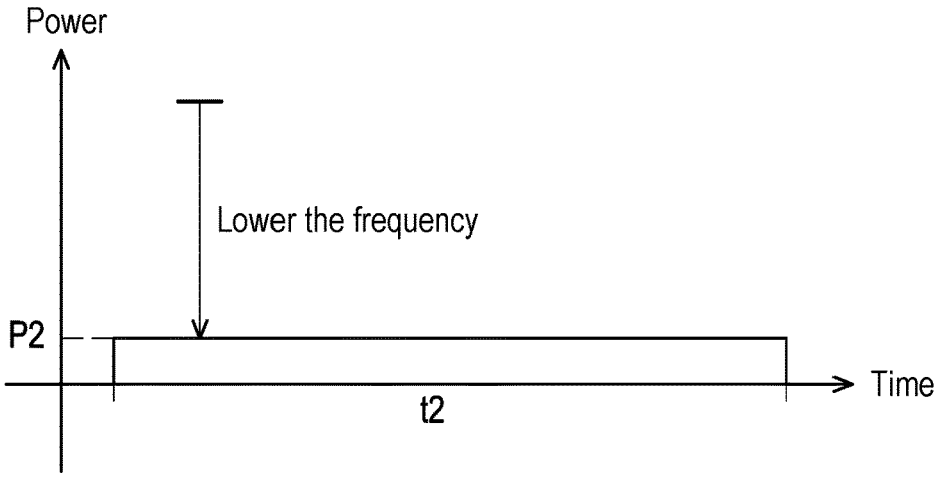
Figure 9:
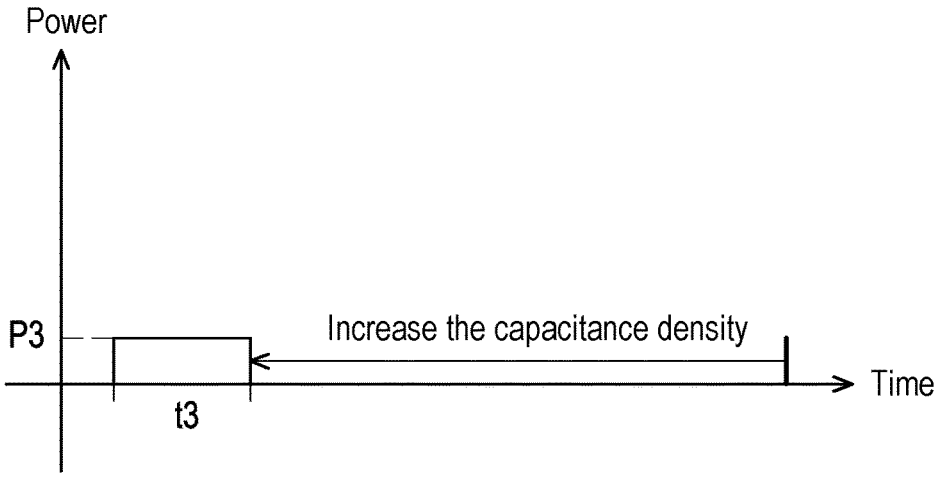
FIG. 9 is a schematic diagram illustrating a page update time and power of an e-paper display panel according to an embodiment of the disclosure.

FIG. 7 and FIG. 8 are schematic diagrams illustrating a page update time and power of an e-paper display panel. FIG. 9 is a schematic diagram illustrating a page update time and power of an e-paper display panel according to an embodiment of the disclosure. Referring to FIG. 7 to FIG. 9, in FIG. 7 and FIG. 8, by lowering the page update frequency of the e-paper display panel 110, the power consumption of the e-paper display panel 110 may be reduced from a power P1 of FIG. 7 to a power P2 of FIG. 8. However, reducing the power consumption only by lowering the page update frequency of the e-paper display panel 110 may cause the page update time to be increased from a time length t1 of FIG. 7 to a time length t2 of FIG. 8. In FIG. 8 and FIG. 9, with a design in which the capacitance density of the storage capacitor 220 is increased, such as being designed to be greater than 50 $\mu F/m^2$, the page update time may be reduced from the time length t2 of FIG. 8 to a time length t3 of FIG. 9. As a result, by lowering the page update frequency of the e-paper display panel 110 and increasing the capacitance density of the storage capacitor 220, the power consumption may be effectively reduced and the display quality may be maintained.

In summary of the above, in the embodiments of the disclosure, since the transistor device is the oxide thin-film transistor and the storage capacitor has a high capacitance density, when the e-paper display panel is operated in the low page update frequency mode, the power consumption may be reduced and favorable display quality may be maintained at the same time.

Although the disclosure has been described with reference to the above embodiments, they are not intended to limit the disclosure. It will be apparent to one of ordinary skill in the art that modifications to the described embodiments may be made without departing from the spirit and the scope of the disclosure. Accordingly, the scope of the disclosure will be defined by the attached claims and their equivalents and not by the above detailed descriptions.

What is claimed is:

1. An e-paper display apparatus, comprising:

an e-paper display panel comprising a plurality of pixel circuits arranged in an array, wherein each of the pixel circuits comprises a transistor device, wherein the transistor device is an oxide thin-film transistor, a set of a plurality of signal waveforms for driving the pixel circuits to display an image page comprises a plurality of frames, and in a low panel frequency mode, a number of the frames is less than ten, wherein each of the pixel circuits further comprises a storage capacitor coupled to the transistor device, and a capacitance density of the storage capacitor is greater than 50 $\mu F/m^2$.

2. The e-paper display apparatus according to claim 1, wherein, in the low panel frequency mode, a page update frequency of the e-paper display panel is less than 30 Hz.

3. The e-paper display apparatus according to claim 1, wherein a material of a channel layer of the oxide thin-film transistor is indium gallium zinc oxide or indium zinc tin oxide.

4. An e-paper display panel comprising a plurality of pixel circuits arranged in an array, wherein each of the pixel circuits comprises a transistor device, a storage capacitor, and a pixel capacitor, and a data voltage drives the storage capacitor and the pixel capacitor through the transistor device to cause the e-paper display panel to display an image page, wherein the transistor device is an oxide thin-film transistor, and a capacitance density of the storage capacitor is greater than 50 $\mu F/m^2$.

5. The e-paper display panel according to claim 4, wherein a set of a plurality of signal waveforms for driving the pixel circuits to display the image page comprises a plurality of frames, and in a low panel frequency mode, a number of the frames is less than ten.

6. The e-paper display panel according to claim 5, wherein, in the low panel frequency mode, a page update frequency of the e-paper display panel is less than 30 Hz.

7. The e-paper display panel according to claim 4, wherein a material of a channel layer of the oxide thin-film transistor is indium gallium zinc oxide or indium zinc tin oxide.

* * * * *